US007850062B2

(12) United States Patent
Christensen et al.

(10) Patent No.: US 7,850,062 B2
(45) Date of Patent: Dec. 14, 2010

(54) INTEGRATED TAB FILE SYSTEM

(75) Inventors: Duane Christensen, Hastings, MN (US); Michael B. Lasky, Atlanta, GA (US)

(73) Assignee: Smead Manufacturing Company, Hastings, MN (US)

( * ) Notice: Subject to any disclaimer, the term of this patent is extended or adjusted under 35 U.S.C. 154(b) by 782 days.

(21) Appl. No.: 11/842,597

(22) Filed: Aug. 21, 2007

(65) Prior Publication Data

US 2008/0041924 A1 Feb. 21, 2008

Related U.S. Application Data

(60) Provisional application No. 60/839,090, filed on Aug. 21, 2006.

(51) Int. Cl.
*B65D 27/00* (2006.01)
*B65D 37/00* (2006.01)

(52) U.S. Cl. ..... 229/67.1; 229/67.4

(58) Field of Classification Search ..... 229/67.1–67.4
See application file for complete search history.

(56) References Cited

U.S. PATENT DOCUMENTS 783,365 A * 2/1905 Coleman ..... 229/67.1
1,048,577 A * 12/1912 Pardoe, Jr. ..... 40/359
1,115,216 A 10/1914 Laviolette
1,308,471 A 7/1919 Barker
1,743,191 A * 1/1930 Charlton ..... 40/359
2,039,752 A 5/1936 Thomas
3,371,850 A * 3/1968 Gorman ..... 229/68.1
3,966,113 A 6/1976 Tipton
4,014,434 A 3/1977 Thyen
4,479,733 A * 10/1984 Segal ..... 402/79
4,602,734 A * 7/1986 Thompson ..... 229/67.4
4,617,223 A 10/1986 Hiscock et al.
4,910,066 A 3/1990 Foisie
5,066,045 A * 11/1991 Hawes et al. ..... 281/45
5,174,606 A 12/1992 Hure
5,417,509 A * 5/1995 Schwartz ..... 402/79
5,447,334 A * 9/1995 Hartsock ..... 281/45
5,966,852 A 10/1999 Drzewiecki
5,996,881 A 12/1999 Smith
6,138,900 A * 10/2000 Zeiler ..... 229/67.4
6,209,778 B1 4/2001 Henrikson et al.

(Continued)

OTHER PUBLICATIONS

"Tab Cut Filing Envelopes", Smead Catalog, p. 640, 2006.

*Primary Examiner*—Jes F Pascua
(74) *Attorney, Agent, or Firm*—Altera Law Group, LLC

(57) ABSTRACT

An integral tab 2-D or 3-D tab for a folder, and a method of making same is disclosed. The integral 2-D (flat) tab 300 is provided near the apex of the folder by cutting free/lose a portion of the existing flap material 14 of the hanging folder itself without the need for additional tabs or material being affixed. The cut creates the tab without additional material required. The 3-D tab 300 version is created adding a triangular portion 301 which is folded onto itself so that one edge surface is at an angle relative to the panels of the file folder allowing it to be read from the side and top. A perforated version allows for user selectable tab and a plurality of placements across the common edge allows the user to select the tab position.

7 Claims, 11 Drawing Sheets

U.S. PATENT DOCUMENTS

| | | | | |
|---|---|---|---|---|
| D450,091 | S | 11/2001 | Henrikson et al. | |
| 6,332,285 | B1 | 12/2001 | Aaldenberg | |
| 6,352,198 | B1 * | 3/2002 | Flynn et al. | 229/70 |
| 6,367,689 | B1 * | 4/2002 | Flynn et al. | 229/68.1 |
| 6,385,860 | B1 | 5/2002 | MacWilliams et al. | |
| 6,453,589 | B1 | 9/2002 | Schwartz | |
| 6,764,101 | B2 | 7/2004 | MacWilliams et al. | |
| 6,808,104 | B2 * | 10/2004 | Cobble | 229/67.1 |
| 6,845,864 | B2 * | 1/2005 | Taw et al. | 206/308.1 |
| D582,983 | S * | 12/2008 | McCarthy et al. | D19/99 |
| 7,536,812 | B1 | 5/2009 | Fasbender | |
| 7,628,426 | B1 * | 12/2009 | Rowe et al. | 281/29 |
| 2001/0021339 | A1 | 9/2001 | Pacione | |
| 2002/0050711 | A1 | 5/2002 | MacWilliams et al. | |
| 2002/0089171 | A1 | 7/2002 | Silvestre | |
| 2004/0051296 | A1 | 3/2004 | MacWilliams et al. | |
| 2004/0195821 | A1 | 10/2004 | Ghent | |
| 2005/0022718 | A1 | 2/2005 | Weisenfeld | |
| 2005/0022719 | A1 | 2/2005 | Weisenfeld | |
| 2009/0205231 | A1 * | 8/2009 | Fasbender | 40/359 |

* cited by examiner

INTEGRATED TAB FILE SYSTEM

CROSS REFERENCE TO RELATED APPLICATION

The present application claims the benefit of U.S. Provisional Application Ser. No. 60/839,090 filed on 21 Aug. 2006, the complete subject matter of which is hereby incorporated herein by reference in its entirety.

FIELD OF THE INVENTION

The present invention is directed to a system for providing integral tab marking for the edges of a wallet or expanding file-like products and a method of making same.

BACKGROUND

Folders, known as wallets, expanding files and the like, suffer from the fact that they do not provide a convenient way to mark their contents on the outside of the wallet. Traditionally, labeling the outside of the wallet with adhesive labels or merely writing on the surface was the only solution, but markings are invisible if the wallets are on a shelf or in a carrier such as a brief case, where the markings are occluded by adjacent folder, books, etc, which block visual access to the markings.

A solution is needed so that marking can be seen despite the occlusions mentioned above. Furthermore, structure used for marking must be inexpensive to manufacture and durable.

There are other issues relevant to the solution of the present invention and they are detailed below.

BRIEF SUMMARY

The present invention relates to a product and process of making a tab integral to the folder or wallet which makes it possible to mark indicia thereon which will be viewable even if the wallet/folder is located between other products, which would make viewing of markings on the major faces impossible. It also allows the manufacture of folders without additional material to be provided for the tabs. By using user selectable tabs, the manufacturer can provide one folder for all tab positions (such as center, left, right) and have the user decide which ones to liberate from the leaves from which they are formed. Two or three dimensional tabs are also possible.

There is also disclosed a file folder having front rear and bottom walls having a front panel having a top and bottom edge, a rear panel having a top and bottom edge, a bottom panel joining said front and rear panels, a fold over cover portion extending from said top edge of the rear panel and capable overlying a portion of the front panel and forming at least a partial top to the folder, and a tab shaped user separable portion in said cover portion configured to allow a user to release the tab shaped portion from the cover portion thereby creating a tab extending from said top edge of said rear panel and creating an opening in said cover portion for said tab to protrude therethrough.

Also disclosed is a file folder having first and second leaves with top and bottom edges on each leaf, said leaves being connected at one of each of said edges to form a fold line; and a tab is a separable portion of one of said leaves formed from a portion of one of said leaves, said tab having its base generally along said fold line, and extending away from the leaf from which it was formed, leaving an aperture in that leaf corresponding to that the material freed from said leaf to create said tab.

Also disclosed is a method of making a folder having at least two leaves joined at a common edge, and having user selectable integral indicia tab having a front and back leaf of material being joined at a common edge to form a folder; perforating an outline of a tab into one of said leaves, leaving the base of the tab unperforated at the common edge; whereby, the user may elect to free the perforated tab from its leaf at said perforations.

The perforations may have a plurality of tab outlines along said common edge and may include a method wherein the step of perforating further includes the method of making the tab three dimensional by providing a plurality of scores into the tab portion to provide the ability for the user to configure the tab into a triangular extension; providing an affixation material at the distal end of the tab so that it may be affixed to the other leaf thereby forming a three dimensional tab.

The present invention has many facets and only a few are set forth in this summary. Reference should be had to the detailed description and the claims for a full definition of the invention.

DETAILED DESCRIPTION OF THE INVENTION

The present invention is directed to an integrated tab system for a folder. The tabs may be 2 or 3 dimensional. The term folder, wallet or wallet type folder, is intended to encompass a range of office requisites, such as binders, folios, classification folders, expanding files and similar items, which could benefit from an integral tab for receiving marking/indicia and which hereto for, have not had such an integral feature. Integral or unitary is meant to mean that the tab is part of the wallet or folder and that the tab does not have to be user-attached. It can also mean that the tab is formed directly in the existing material, and does not require an attachment, but that is only the preferred embodiment.

Figure 1:
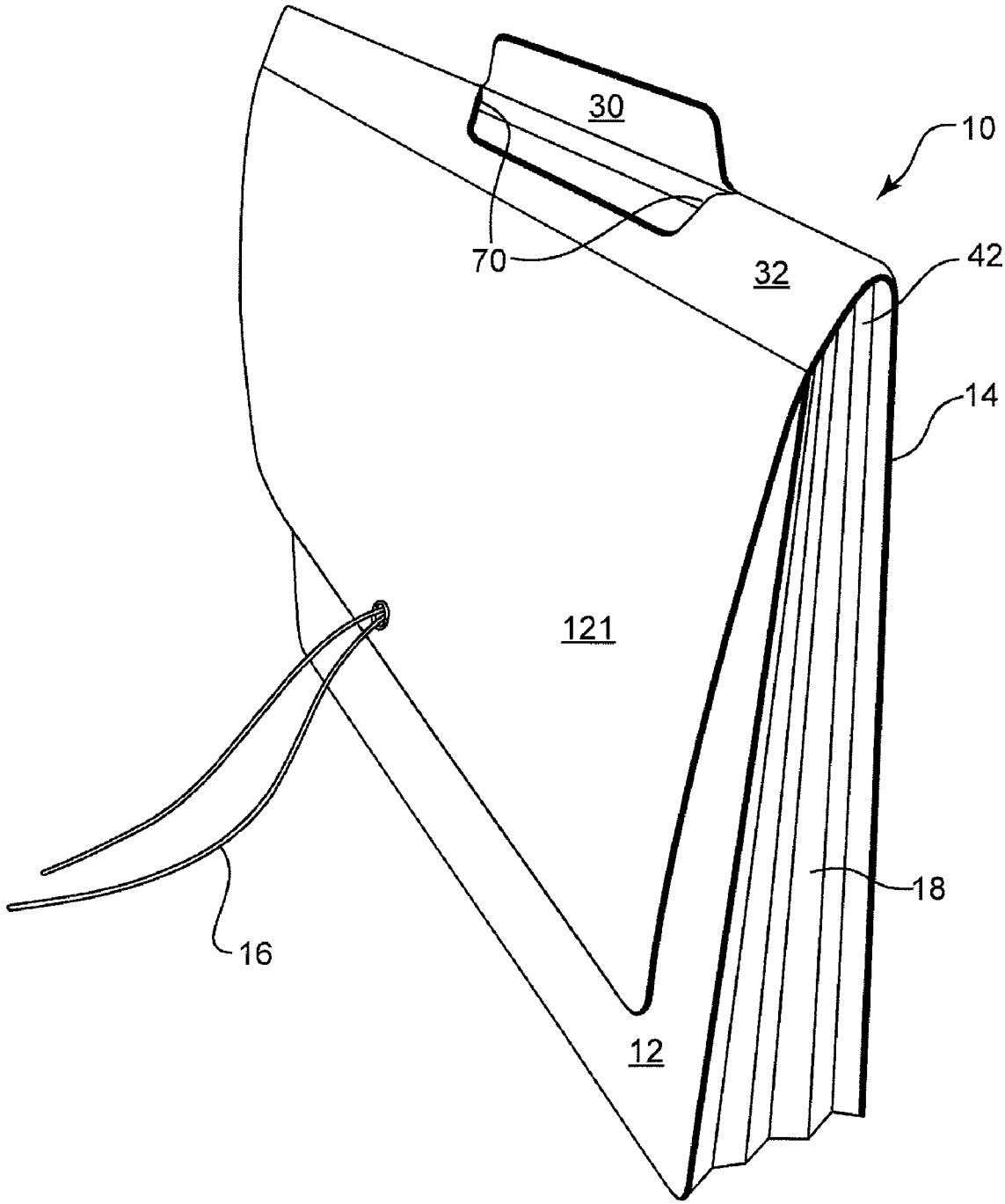
FIG. 1 is a perspective view of a wallet folder with a unitary/integral top tab attached.
Figure 2:
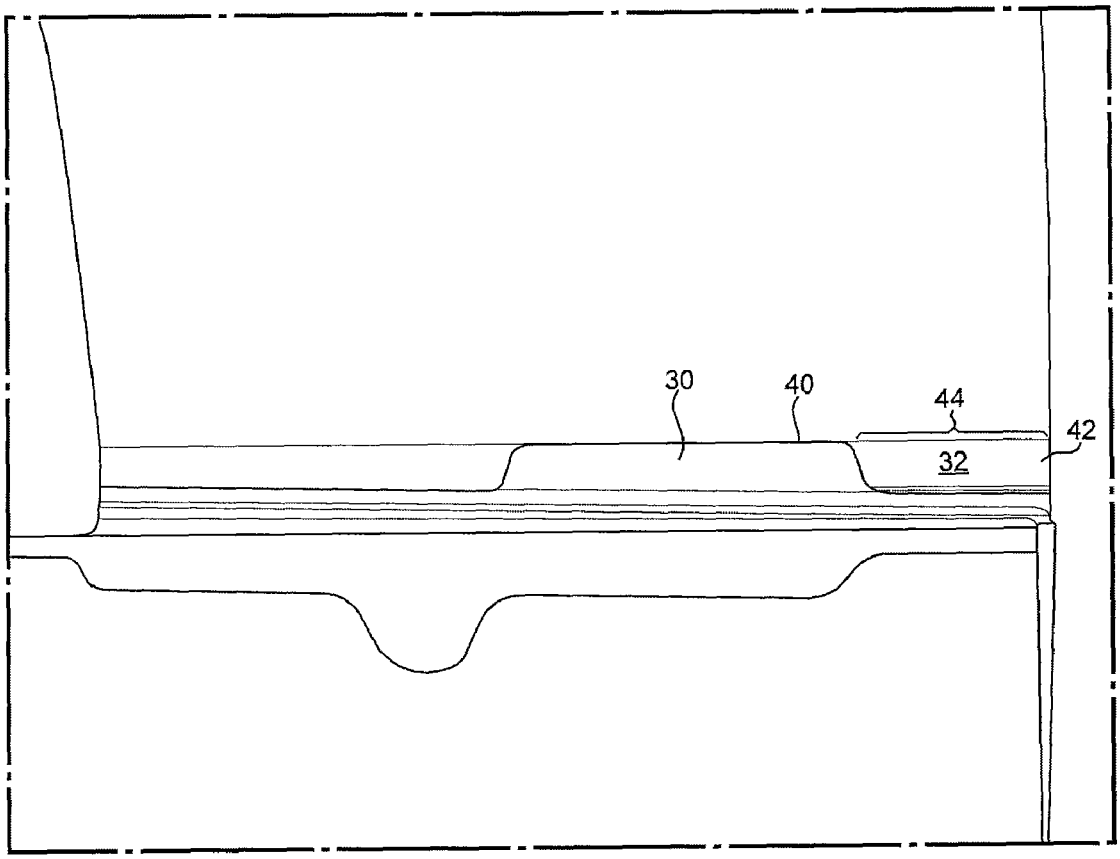
FIG. 2 is a plan view of a wallet with integral tab attached, in an open inside layout.

A typical wallet like folder, such as the expanding file 10 is shown in FIG. 1. In this embodiment, it has front and rear faces 12, 14 with top and bottom ends. The expanding folder 10 shown, has a cover flap 14 which extends from the edge of the rear flap (in fact it is a continuous web in the preferred embodiment, so the term "extending from" includes a continuous or discontinuous web of material) which overlies the front face at least in part and a optional rope or elastic fastener 16. The front and rear faces are joined by sidewalls 18 and bottom 20 (shown best in FIG. 3*a*). In the preferred embodiment, the side and bottom walls are a unitary piece folder twice and have an accordion fold/pleat for expansion. Elastic materials, such as latex could also be used for the expansion section, and of course, it does not have to provide expansion at all.

In the preferred embodiment, a tab 30 is formed by making a separable portion such as by cutting into the flap 14 at its crown portion. The separable portion is may be the die cut as shown, perforations, scoring or any other releasable mechanism which guides the user as to where the break away will occur. In this embodiment, the crown is curved to allow for expansion, but it could be a mere fold at the apex. In such embodiment, a cut 40 is made in the flap 14 in the shape of a tab. The cut shown of FIGS. 1-4 is a right side tab, but the cut can be made anywhere (center, right, or left). In the case of a wallet with an over-flap 14, the cut should be distant from the edge 42 so that a region 44 of structural material remains to support that end of the flap. With stronger material, the tab can be closer to the edge. Alternatively, a reinforcement (such as a wire or plastic strip) can be embedded into region 44 so that it can be made narrow, i.e. the tab being nearly adjacent to the edge 42, with the imposition of the reinforcement providing edge protection.

Figure 3:
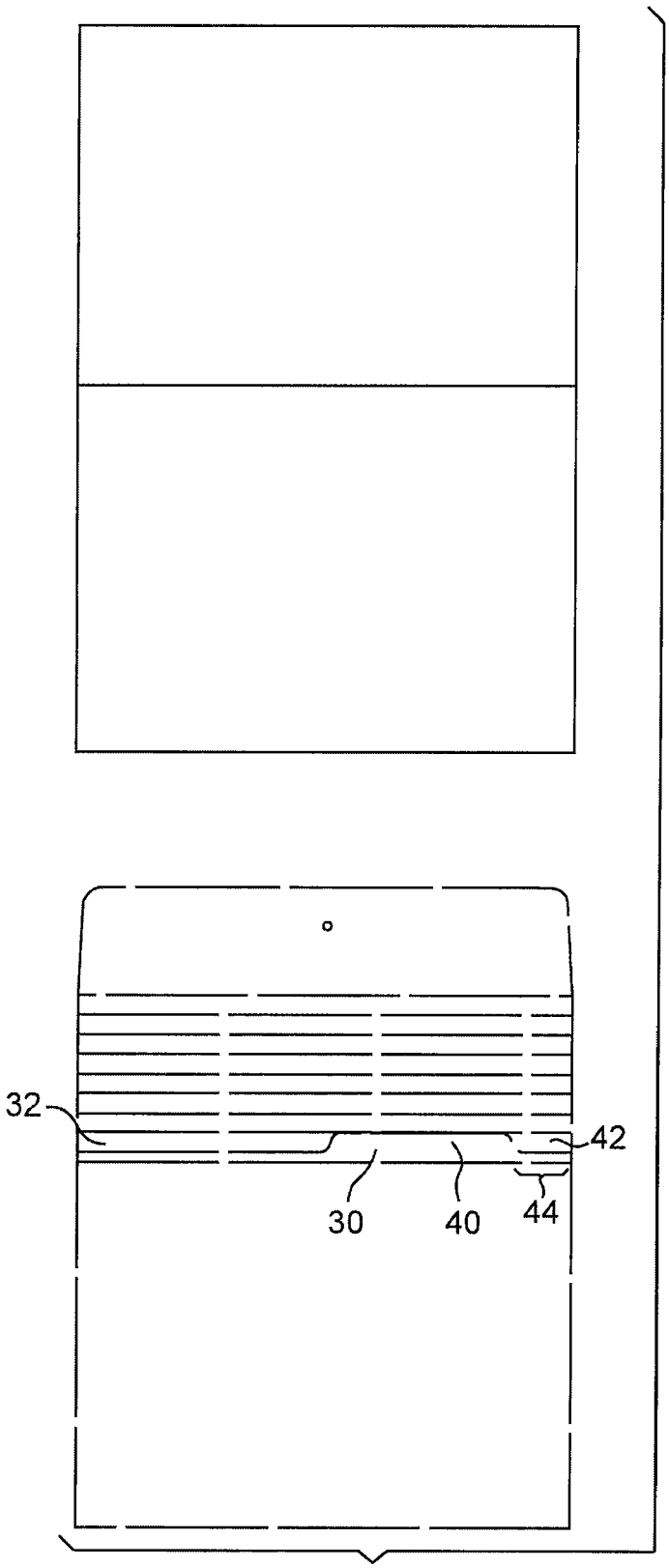
FIG. 3 is a view like FIG. 2 showing an additional insert member.
Figure 4:
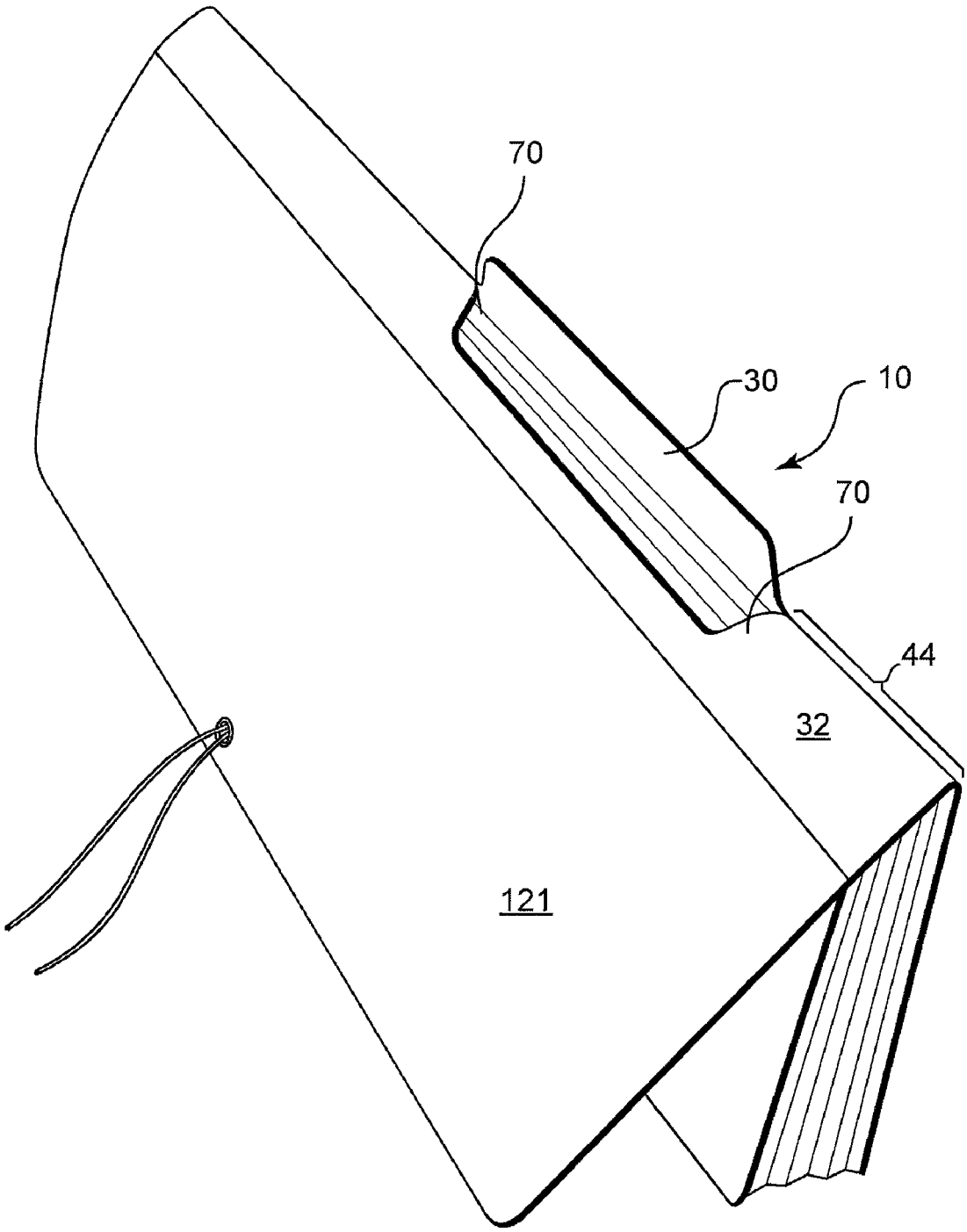
FIG. 4 is a view like FIG. 1 except shown at a different perspective.
Figure 5:
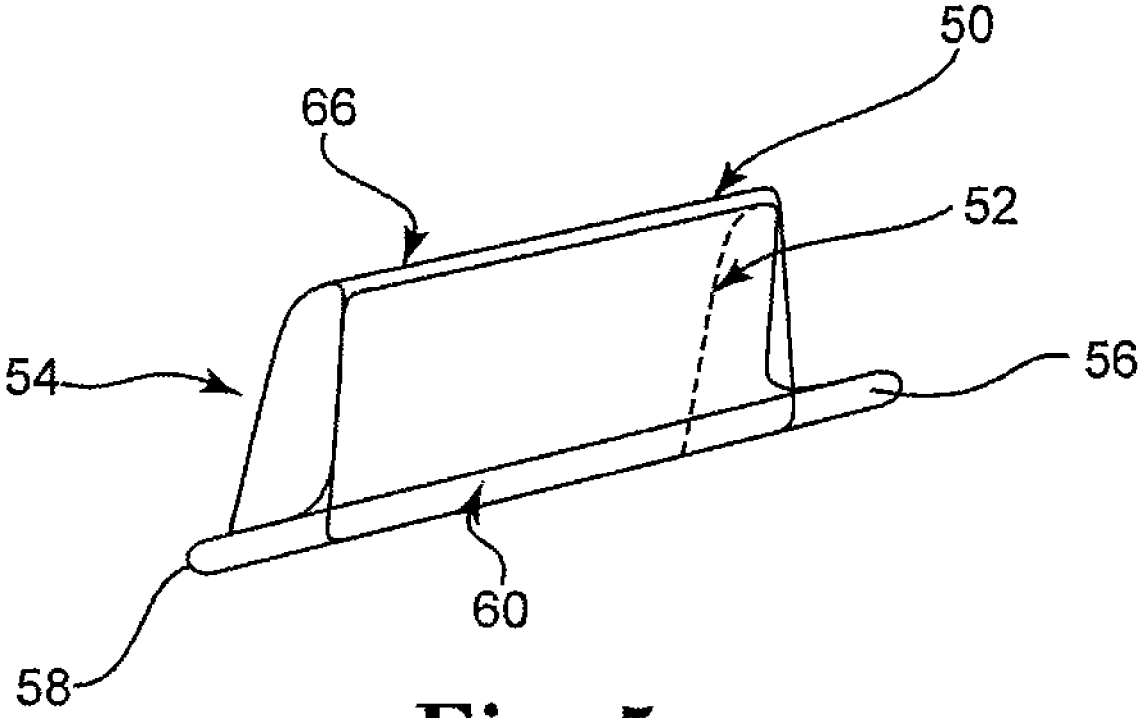
FIG. 5 is a perspective view of a protective shield for the tab.

As can be seen in FIGS. 3 and 4 tab 30 is effectively a cut out from the over-flap material 14.

The flat 30 can also be reinforced by providing a double ply of material in region 32 preferably on the inside surface thereof (see FIG. 3) or by applying a reinforcement, such as a tape, on the inner and/or outer surface. The reinforcement should preferably have a writable surface.

It is also possible to make such a wallet with an open top and still use the present integral tab feature. Flap 14 would be trimmed or non-existent.

Further reinforcement of the tab 30 can be achieve by a slip over translucent shield 50, which has a front and back surface 52, 54 and a gap 60 therebetween. The front and back surfaces would be resiliently biased toward each other by the top edge portion 66 and thus the tab 30 would be captured between the surfaces by the gap.

Figure 3A:
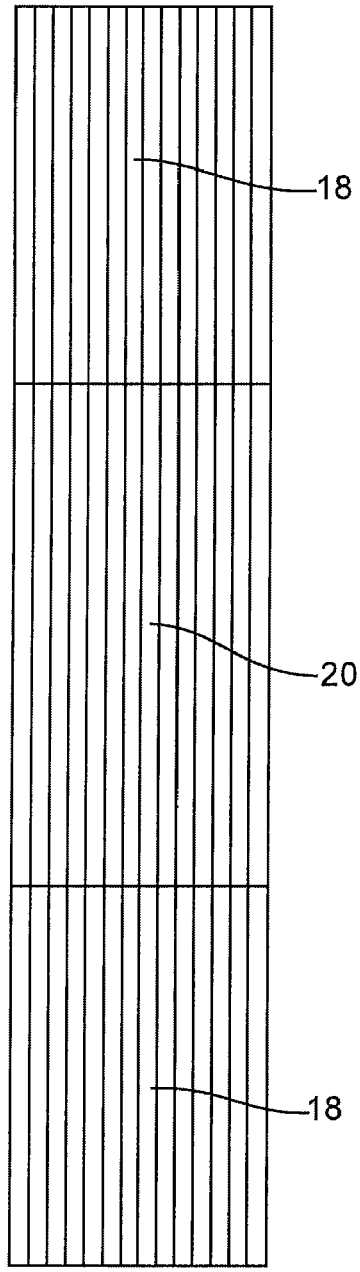

A pair of extensions 56, 58 on either or both surfaces 52, 54 would provide engagement elements to further maintain the shield in place. The extensions and/or the surfaces 52, 54 would be sufficiently bendable and resilient to allow the extensions to engage the portion 70 of the apex region (see FIGS. 1 and 4), thus maintaining a mechanical engagement with the cut out region. The preferred location to cut is at or near the apex Manufacturing of this invention can be made according to means already known for making wallet like folders, usually on a continuous web machine which later attachment of the gusset material 18-20 (FIG. 3*a*). A die cut (see element 40) is made in the web process to cut the pattern for the tab 30 and the tab may then also be reinforced as indicated above.

Figure 6:
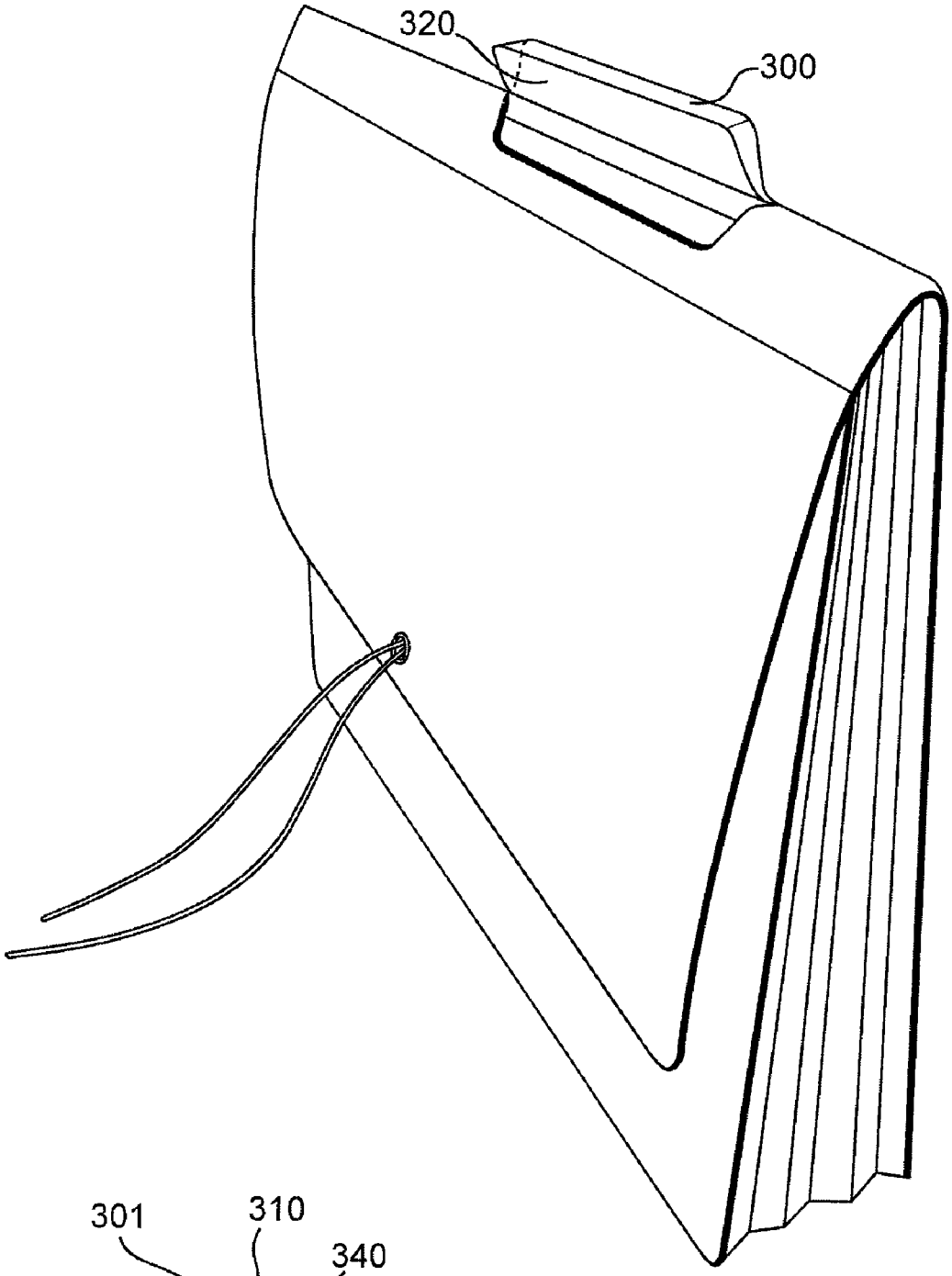
FIG. 6 is a view like FIG. 1 except with a three dimensional tab.
Figure 6A:
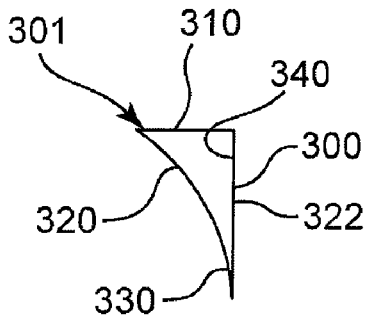
FIG. 6*a* is a schematic view of tab 300 in FIG. 6.

FIGS. 6-6*a* illustrate a modification of the prior structure and method of manufacture. A three dimensional tab 300 is shown. The three dimensions allow the tab to be viewed from the top or sides. The top view may be highly advantageous for use in a brief case where only the top is viewable.

Tab 300 has a top wall 310, side walls 320 and 322 and preferably attachment portion 330 and 340. A preferred way to create the 3-d tab 300 is to use the portion of the flap (or leaf, as in the embodiment below) and score it into three sections with preferably, parallel scores. The three sections 322, 210 and 320 are folded into a triangle and portion 320 is affixed by 322 by adhesive or similar means. An adhesive strip can be supplied integrally or separately. Section 310 may be rigidified by attachment of additional material such as a plastic strip or chemically by applying a solution to that portion or all portions. It is also possible to attach a separate multi-folded strip 301 tab 300 (or 30 as in FIG. 1). The multi-fold strip is preferably as wide as the tab 30 and has portions 340 (affixation point), top 310, front side 320, and a lower affixation portion 330, together forming a triangle with the base tab 300.

When folded as shown in FIG. 6, a three dimensional tab is constructed. Notice that side portion 320 capable of being positioned for side viewing at various angles determined by the point at which portion 330 is attached to tab 300. It may create a top portion 310 which is generally L shaped with respect to tab 300. The exact angle depends on user preference, the length of the various panels or the affixation point of portion 330. The further down the length of tab 300, the more acute the angle of the portion 310 and 320 will be. An obtuse angle for portion 310 panel is likewise achievable by opposite placement. Further, by selective affixation of the various portions the angle of the label can be adjusted to any angle desired from 0-180 degrees. Perpendicular is most common, but a 45 degree angle could be useful for top viewing from a file drawer. Portion 320 will often be shorter than what is shown in FIG. 6*a* because it is preferably taken from the cut out and since a portion of the tab is used to form the surface 310, the remainder 320 which is affixed to 322 is a truncated hypotenuse. The affixation of portion 322 on 300 also provides significant reinforcement to the entire tab as does the triangular shape.

The preferred method of construction involves an additional step to affixing strip 310 by adhesive as indicated.

This strip can be further reinforced by a rigidifying strip (not shown but described in co-pending application Ser. No. 11/833,389, filed Aug. 3, 2007 and of common ownership, which is hereby incorporated by reference). Such strip is formed by scoring the strip with two parallel scores, the space between the scores constituting one face of the tab and rigidifying the space between said scores with a reinforcement, like plastic.

It is also to be understood, that in all embodiments, reinforcement materials such as tape, films, Tyvek® products, etc can be applied to stiffen the tab and against use and abuse. The file would be applied preferably by a discontinuous application in the areas needed. The preferred embodiment would use a film which can be written on so that indicia may be handwritten or printed directly on the film.

Figure 7:
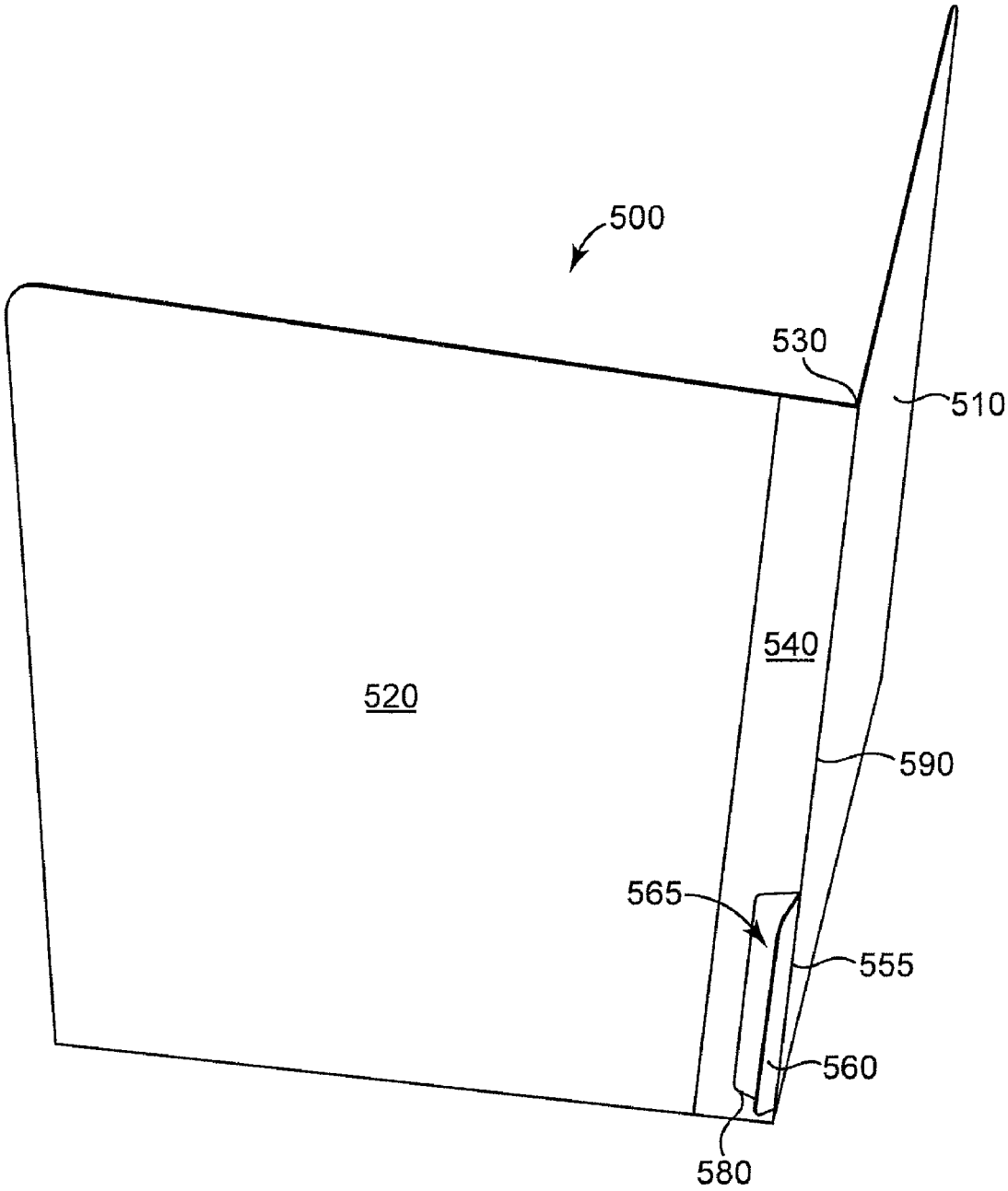
FIG. 7 is an alternative embodiment in the form of a file folder in perspective.
Figure 8:
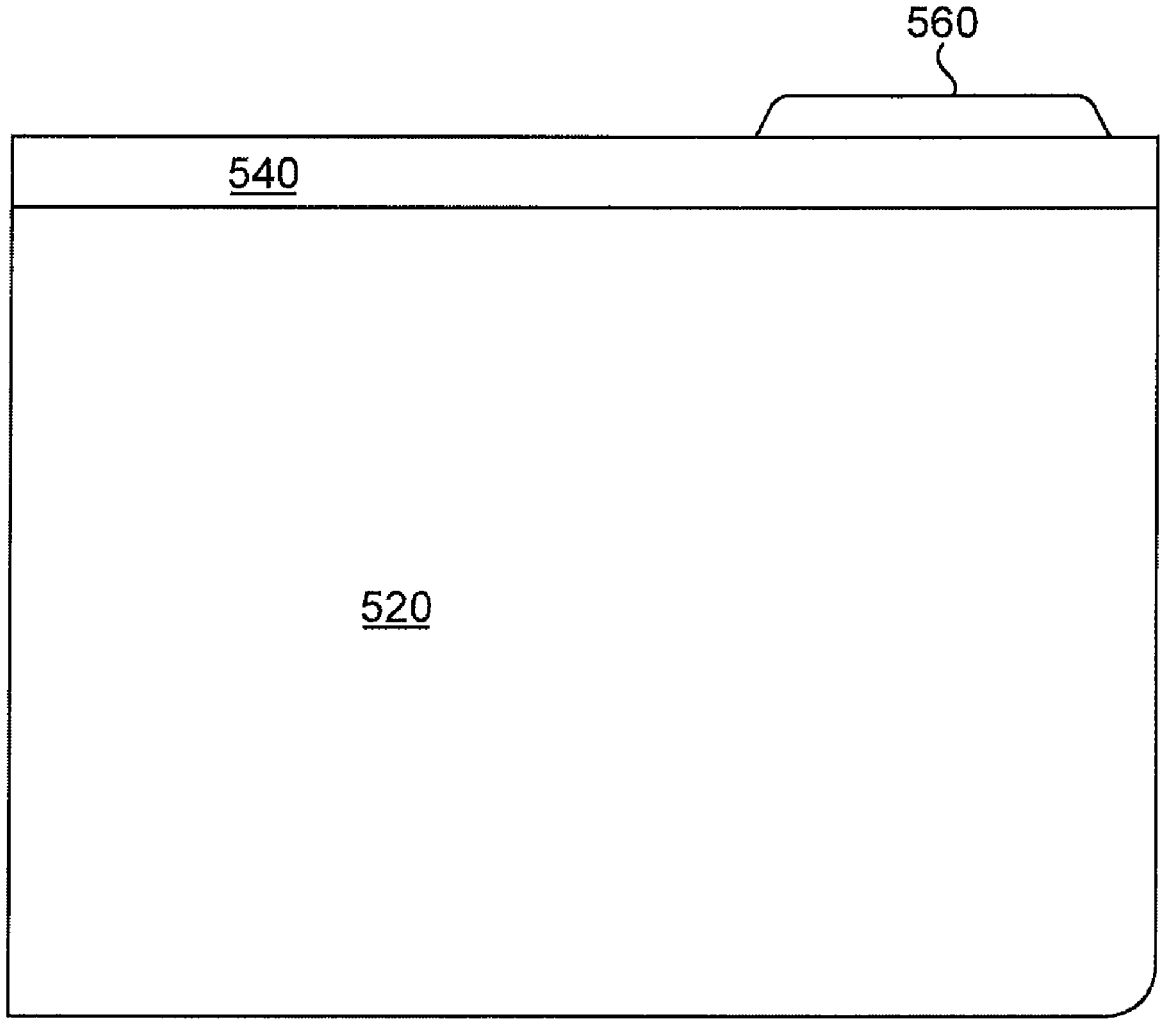
FIG. 8 is a side plan view of the subject matter in FIG. 7.
Figure 9:
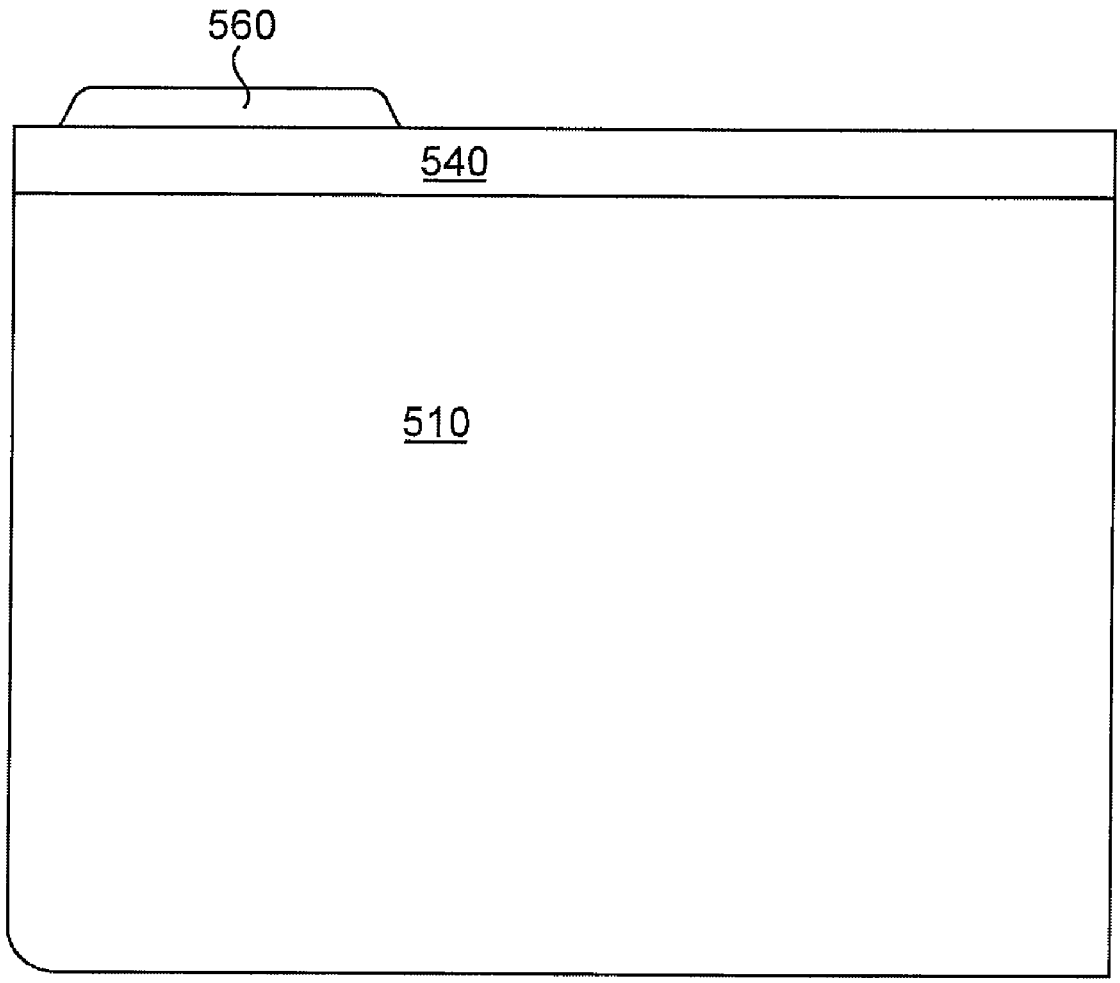
FIG. 9 is a front plan view of the subject matter in FIG. 7.

FIGS. 7-9 illustrate an alternate embodiment, but built according to the present invention, where there is shown a folder 500 having two leaves/panels 510, 520, which are connected or joined at 530, where there may be a joint or just a score in a continuous material. In this embodiment there is further, a reinforcement material 540 applied preferably to a narrow strip on either side of the score/joint. Like in the first embodiment above, the tab 560 is created by cutting into one (or both for multi tab units) of the two leaves to free a portion of the leaf panel which is then flattened to form an edge tab. The tab formed from a portion of one of the leaves, and has its base 555 generally along said fold line, with the free portion of the tab extending away from the leaf from which it was formed, leaving an aperture 565 in that leaf from where the tab was removed.

Figure 7A:
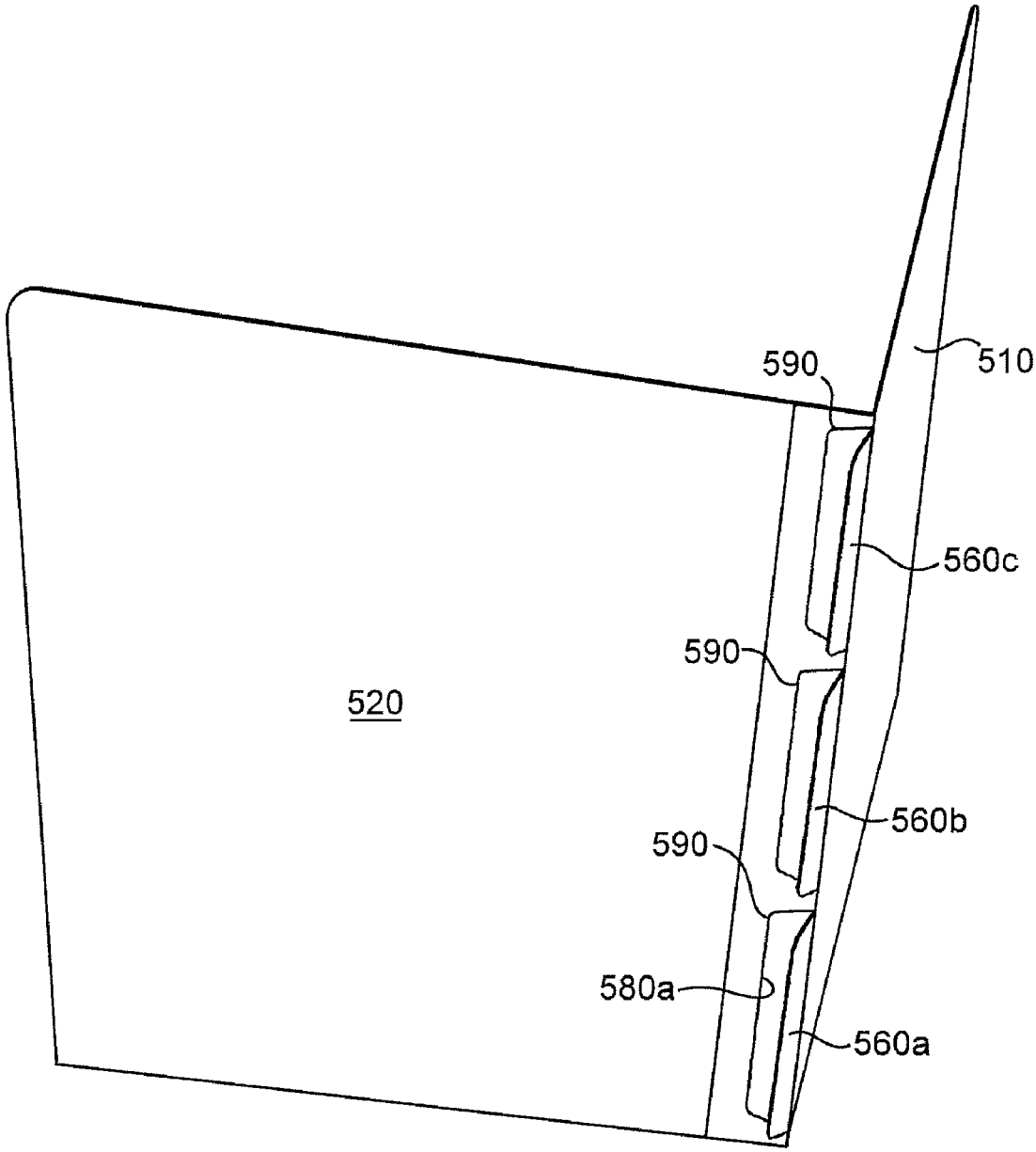
FIG. 7*a* is an alternative embodiment to the folder in FIG. 7.

The cut is preferably with sloping sides as shown. It is possible to perforate at tab outline where the cut line 580 would be to allow the user to elect to "liberate" a tab as needed. Thus the folder could have multiple tab perforations along the joint/score line 590 allowing the user to elect which tab position to use. In FIG. 7*a*, there is shown a configuration where a single folder can be used to achieve multiple efficiencies: 1) no extra material is required in the formation of the tab, either flat or 3*d*, and 2) the manufacturer can stock only one type of file no matter how many "tab cuts" are desired. The user can select to open any or all of the tab cuts (perforation) 560*a, b*, or *c*. Note that the term "perforation" is meant to be a broad term to include other forms of user selectable breakaway tabs, including but not limited to scoring, slashing, precut lines with only the stiffness of the tab keeping it folded (out of use) or a temporary tacking adhesive, such as rubber cement, or any similar system to accomplish the above stated objective. It will be understood that this user selectable tab system described for FIGS. 7 and 7*a* is applicable to all embodiments herein.

Figure 10:
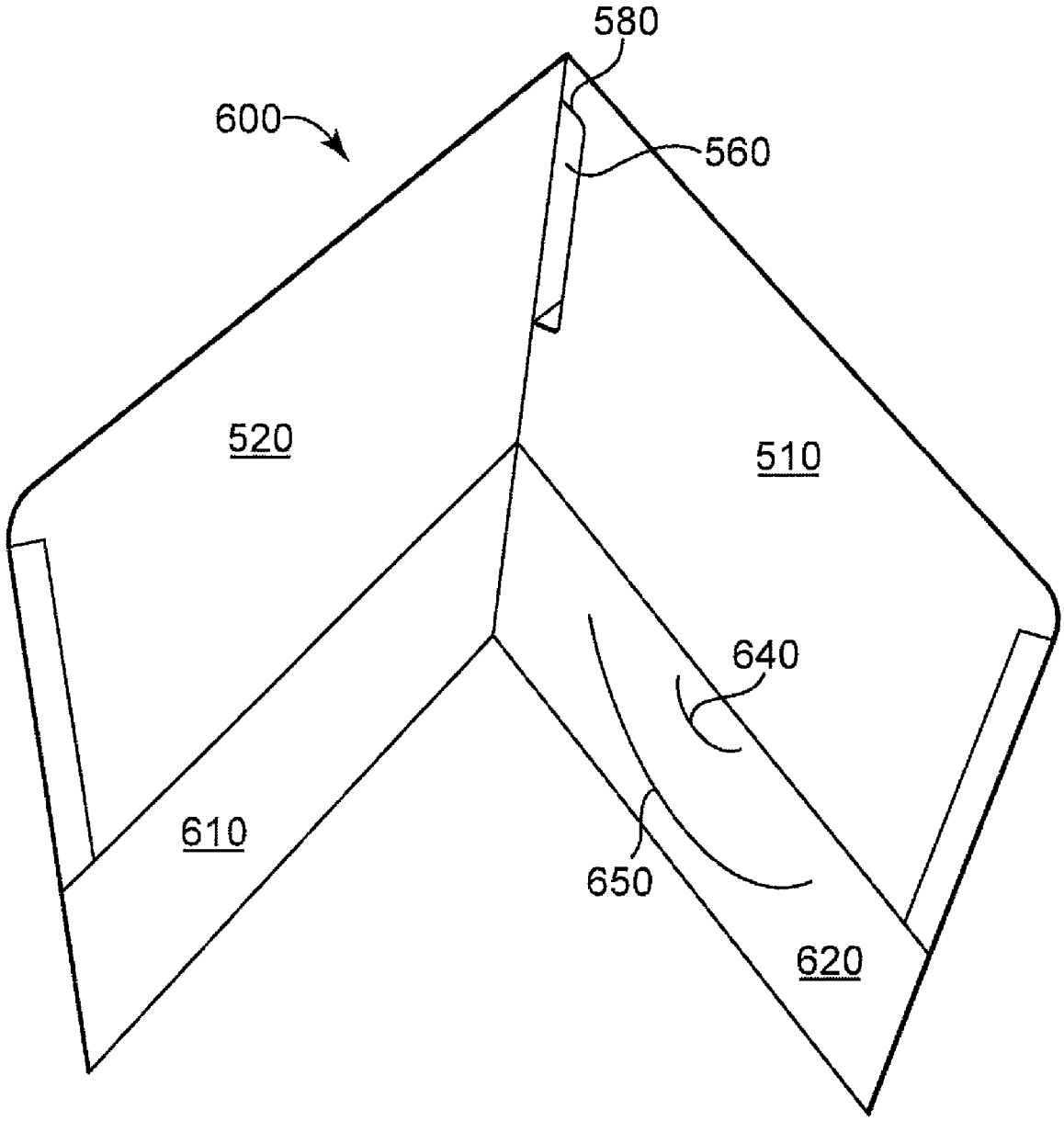
FIG. 10 is an alternate embodiment from that in FIG. 7, except as a pocket folder, in perspective.

The embodiment shown in FIG. 10 is similar to that in FIGS. 7-9 except that this folder 600 is a pocket folder having pockets 610, 620. The tab cut out is the same as that for the previous embodiment and may likewise use optional perforations and multiple tabs in a single unit as explained above. In this embodiment a pair of semi-circular concentric arcs 640 and 650 are cut into the pocket 620. These accommodate disks and similar objects with the larger width/circumferential extend of the disk residing under cut 650 and the small arc 640 overlies the disk, thereby holding it in place.

The description of the invention including its applications and advantages as set forth herein is illustrative and is not intended to limit the scope of the invention, which is set forth in the claims. Variations and modifications of the embodiments disclosed herein are possible and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A file folder having front rear and bottom walls comprising:

a) a front panel having a top and bottom edge, b) a rear panel having a top and bottom edge c) a bottom panel joining said front and rear panels, d) a fold over cover portion extending from said top edge of the rear panel and capable overlying a portion of the front panel and forming at least a partial top to the folder, and e) a tab shaped user separable portion in said cover portion configured to allow a user to release the tab shaped portion from the cover portion thereby creating a tab extending from said top edge of said rear panel and creating an opening in said cover portion for said tab to protrude therethrough said tab including:

a plurality of adjacent parallel score lines spaced from each other foldable into a triangular shape to form a three dimensional tab, said tab having an affixation portion user affixable to said rear panel at a user selectable location, thereby allowing the user to select a display angle of the tab.

2. The folder of claim 1 wherein said display angle is between 0-180 degrees.

3. The folder of claim 1 wherein said tab includes a plurality of separateable tabs spaced apart from each other.

4. The folder of claim 1 wherein said separable portion of perforations.

5. The folder of claim 1 wherein said separable tab shaped portion is formed of a plurality of separable tab shaped portions spaced across a file edge.

6. The folder of claim 1, wherein the tab further includes a rigidifying material between at least two adjacent score line so that when said tab is folded along said scores, a 3-dimensional tab is formed.

7. The folder of claim 1, further including a tab protector configured to be fitted on said tab, said protector including a pair of translucent sidewalls joined at one end and a pair of later protections extending longitudinally from each of the other ends, said projections being bendable so that they can be fitted into a slot in overlying portion of the rear panel and then expand to become secured onto the folder.

* * * * *